US008648787B2

(12) United States Patent
Yen et al.

(10) Patent No.: US 8,648,787 B2
(45) Date of Patent: Feb. 11, 2014

(54) PIXEL CIRCUITRY FOR DISPLAY APPARATUS

(75) Inventors: Cheng-Chi Yen, Tainan County (TW); Ju-Tien Cheng, Tainan County (TW)

(73) Assignee: Himax Display, Inc., Tainan (TW)

( * ) Notice: Subject to any disclaimer, the term of this patent is extended or adjusted under 35 U.S.C. 154(b) by 893 days.

(21) Appl. No.: 12/371,833

(22) Filed: Feb. 16, 2009

(65) Prior Publication Data

US 2010/0207863 A1 Aug. 19, 2010

(51) Int. Cl.
*G09G 3/36* (2006.01)

(52) U.S. Cl.
USPC ..... 345/98; 345/55; 345/87; 345/90; 345/92; 345/96; 345/100; 345/204; 345/205; 345/206; 345/209; 349/43; 257/59

(58) Field of Classification Search
USPC ..... 345/98, 55, 90, 92, 87, 96, 100, 345/204–206, 209; 349/43; 257/59
See application file for complete search history.

(56) References Cited

U.S. PATENT DOCUMENTS

| | | | | |
|---|---|---|---|---|
| 5,581,273 | A * | 12/1996 | Yoneda et al. | 345/90 |
| 6,456,267 | B1 * | 9/2002 | Sato et al. | 345/92 |
| 6,542,142 | B2 * | 4/2003 | Yumoto et al. | 345/90 |
| 6,771,241 | B2 * | 8/2004 | Miyazawa et al. | 345/87 |
| 7,193,602 | B2 * | 3/2007 | Morita | 345/100 |
| 7,564,452 | B2 * | 7/2009 | Komiya | 345/204 |
| 2004/0140969 | A1 | 7/2004 | Morita | |
| 2005/0017929 | A1 * | 1/2005 | Sano et al. | 345/76 |
| 2007/0146277 | A1 * | 6/2007 | Miyazawa | 345/92 |
| 2007/0195018 | A1 * | 8/2007 | Chiou et al. | 345/76 |

FOREIGN PATENT DOCUMENTS

| | | |
|---|---|---|
| CN | 1372242 | 10/2002 |
| CN | 201159815 | 12/2008 |
| CN | 101364764 | 2/2009 |
| TW | 200513023 | 4/2005 |

OTHER PUBLICATIONS

"Office Action of Taiwan Counterpart Application", issued on Apr. 19, 2013, p. 1-p. 9, in which the listed references were cited.

* cited by examiner

*Primary Examiner* — Joseph Feild
*Assistant Examiner* — Linh N Hoffner
(74) *Attorney, Agent, or Firm* — J.C. Patents

(57) ABSTRACT

A pixel circuitry for a display apparatus is provided herein. The pixel circuitry includes a first storage element, and a switching element composed of a plurality of switches. The first storage element has a first terminal receiving a pixel signal and a second terminal coupled to a first voltage. The first storage element is used for storing the pixel signal. The switching element includes a first switch and a second switch respectively conducted in response to a first signal and a second signal. Each of the first switch and the second switch has an input terminal coupled to a data line and an output terminal coupled to the first storage element. The cooperation of the first switch and the second switch has benefit of delivering the pixel signal without influence of body effect.

1 Claim, 4 Drawing Sheets

PIXEL CIRCUITRY FOR DISPLAY APPARATUS

BACKGROUND OF THE INVENTION

1. Field of Invention

The present invention relates to a pixel circuitry for a display apparatus, and more particular, to a pixel circuitry that increases a voltage range of a pixel signal passing through a scan switch to a pixel electrode, and/or increases a capacitance of a storage element for storing the pixel signal under low operation frequency.

2. Description of the Related Art

A display panel of a liquid crystal display (LCD) is composed of a pixel array which includes a plurality of pixel circuitries. FIG. 1A is a circuit diagram of a conventional pixel circuitry. Referring to FIG. 1A, the pixel circuitry 100A includes a switch element 111A and a storage capacitor 112A. The switch element 111A is implemented by an N-type metal-oxide-semiconductor (NMOS) transistor having a gate coupled to a scan line SC for receiving a scan signal, a first source/drain coupled to a data line DA for receiving a pixel signal, and a second source/drain coupled to a pixel electrode Pix. The storage capacitor 112A is also implemented by an NMOS transistor having a gate coupled to the pixel electrode Pix and both of a first source/drain and a second source/drain coupled to a voltage, e.g. a voltage of a common electrode. When the scan signal is asserted to conduct the switch element 111A, the pixel signal on the data line DA is delivered to the pixel electrode Pix and then is stored within the storage capacitor 112A to control orientation of liquid crystal.

As known, the NMOS transistors are fabricated on a P-type substrate coupled to a negative power voltage VSSA. If a voltage range of the pixel signal is between a positive power voltage VDDA and the negative power voltage VSSA, not all pixel signals within such voltage range can be delivered to the pixel electrode Pix via the switch element 111 due to body effect. Namely, only pixel signals within a voltage range between the voltage VSSA and the voltage (VDDA−ΔV) can be delivered to the pixel electrode Pix, except those within a high-voltage range between the voltage (VDDA−ΔV) and the voltage VDDA. As a result, the voltage range passing though the switch element 111 is restricted.

In addition, the storage capacitor 112A is also called as an NMOS capacitor whose capacitance changes as a gate voltage under lower operation frequency. FIG. 1C is a curve of a capacitance of the MOS capacitor under lower operation frequency. Referring to FIG. 1C, a curves 101 shows the capacitance Cgb of the NMOS capacitor. When the gate voltage Vg is smaller than zero, an accumulation layer is formed between the gate and the substrate to serve as a capacitor. When the gate voltage Vg is larger than zero, but smaller than a threshold voltage Vtn, a depletion layer is formed in the substrate under a gate oxide, and the depth of the depletion layer is increased with the increase of the gate voltage Vg to reduce the capacitance Cgb of the NMOS capacitor. In the meanwhile, the capacitance Cgb of the NMOS capacitor is constructed of a gate capacitor and the depletion layer capacitor in series connection, wherein the gate capacitor is formed by two parallel plates of the gate and the depletion layer. In other words, under low operation frequency, the capacitance Cgb of the MOS capacitor is not as expected when the gate voltage Vg is larger than zero, but smaller than the threshold voltage Vtn. When the gate voltage Vg is larger than the threshold voltage Vtn, a channel layer is formed in the substrate under a gate oxide layer, and the capacitance Cgb of the NMOS capacitor is constructed of the gate capacitor formed by two parallel plates of the gate and the channel layer.

FIG. 1B is a circuit diagram of a conventional pixel circuitry. Referring to FIG. 1B, the switch element 111B and the storage capacitor 112B are implemented by PMOS transistors, wherein the PMOS transistors are fabricated on an N-type substrate coupled to the positive power voltage VDDA. Due to body effect, only pixel signals within a voltage range between the voltage (VSSA+ΔV) and the voltage VDDA can be delivered to the pixel electrode Pix, except those within a low-voltage range between the voltage VSSA and the voltage (VSSA+ΔV). As a result, the voltage range passing though the switch element 111B is restricted. Referring to FIG. 1C, a curve 102 shows the capacitance Cgb of the storage capacitor 112 implemented by PMOS transistor and called as PMOS capacitor. Similarly, the capacitance Cgb of the PMOS capacitor is not as expected under low operation frequency when the gate voltage is smaller than zero, but larger than a threshold voltage Vtp. There should be a circuit design in the pixel circuitry to solve the problems of voltage restriction and insufficient capacitance.

SUMMARY OF THE INVENTION

The present invention provides a pixel circuitry that utilizes the switches in parallel connection to deliver pixel signals within a wide voltage range in response to a scan signal without being affected by body effect. In addition, the present invention also provides a pixel circuitry that increases an equivalent capacitance of the storage elements coupled to a pixel electrode for storing the pixel signal.

A pixel circuitry is provided in the present invention. The pixel circuitry includes a first storage element and a switching element composed of a plurality of switches. A first terminal of the first storage element receives a pixel signal, and a second terminal of the first storage element is coupled to a first voltage. The first storage element is used for storing the pixel signal. The switching element includes a first switch and a second switch respectively conducted in response to a first signal and a second signal. An input terminal and an output terminal of each of the first switch and the second switch are respectively coupled to a data line and the first storage element.

In an embodiment of the foregoing pixel circuitry, the first switch and the second switch are respectively an N-type metal-oxide-semiconductor (NMOS) transistor and a P-type metal-oxide-semiconductor (PMOS) transistor.

In an embodiment of the foregoing pixel circuitry, the pixel circuitry further includes a multiplexer for generating the first signal and the second signal according to a scan signal, and the first switch and the second switch are synchronously conducted in response to the first signal and the second signal.

A pixel circuitry is provided in the present invention. The pixel circuitry includes a first switch, a first storage element and a second storage element. The first switch is conducted in response to a scan signal for delivering a pixel signal received by an input terminal thereof to an output terminal thereof. A first terminal and a second terminal of the first storage element are respectively coupled to the output terminal of the first switch and a first voltage. A first terminal and a second terminal of the second storage element are respectively coupled to the output terminal of the first switch and a second voltage. The first storage element and the second storage element are used for storing the pixel signal.

In an embodiment of the foregoing pixel circuitry, the first storage element and the second storage element are respectively an N-type metal-oxide-semiconductor (NMOS) capacitor and a P-type metal-oxide-semiconductor (PMOS) capacitor.

The present invention provides the pixel circuitry that includes the first switch and the second switch in parallel connection for ensuring the pixel signals within a voltage range between a positive power voltage and a negative power voltage substantially fully pass the switching element to the first storage element without the influence of body effect. In addition, the present invention provides the pixel circuitry that includes the first storage element and the second storage element, each of which having one terminal coupled to the output terminal of the first switch, for increasing an equivalent capacitance that can store the pixel signal.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
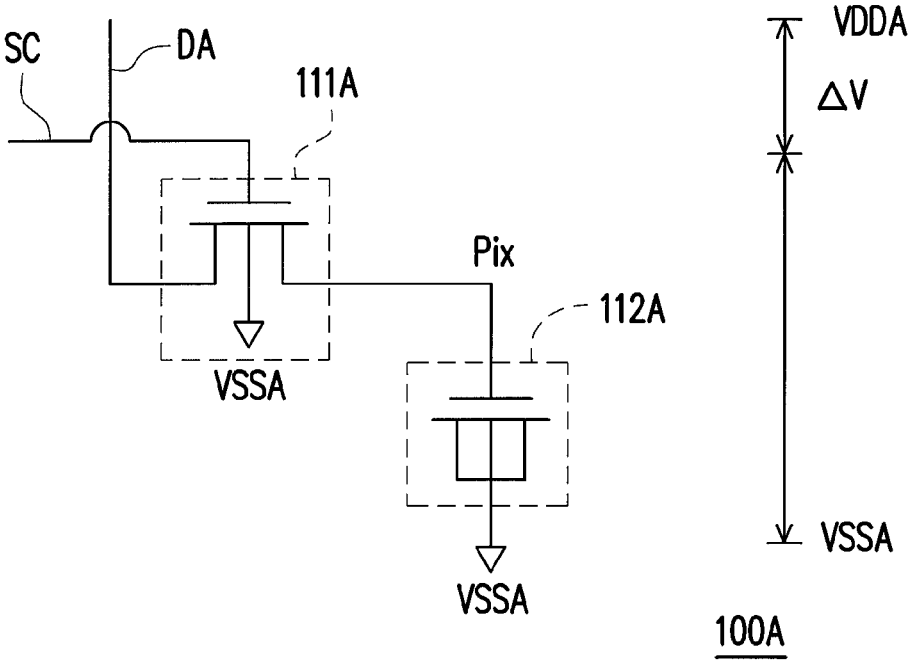
FIG. 1A (PRIOR ART)
FIG. 1A is a circuit diagram of a conventional pixel circuitry.
Figure 1B:
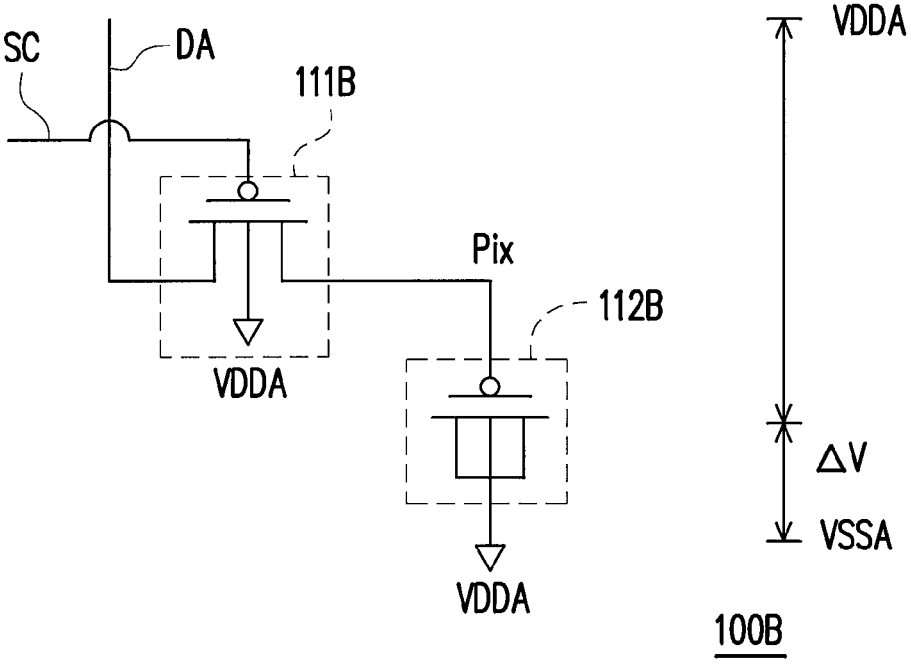
FIG. 1B (PRIOR ART)
FIG. 1B is a circuit diagram of a conventional pixel circuitry.

Reference will now be made in detail to the present preferred embodiments of the invention, examples of which are illustrated in the accompanying drawings. Wherever possible, the same reference numbers are used in the drawings and the description to refer to the same or like parts.

It is assumed that a positive power voltage VDDA and a negative power voltage VSSA are applied on a display apparatus, such as liquid crystal display (LCD). A source driver of the display apparatus can utilize a voltage range between the voltage VDDA and the voltage VSSA for driving liquid crystal to orientate and then to display gray scales of an image. The larger the voltage range for driving liquid crystal is, the easier the discrimination between the gray scales perceived by human eyes is. However, a switch element of a pixel circuitry, implemented by a metal-oxide-semiconductor (MOS) transistor, usually restricts the voltage range for driving liquid crystal due to body effect. In addition, a storage capacitor of the pixel circuitry, implement by MOS capacitor, has insufficient capacitance to store a pixel signal when a voltage of the pixel signal is between zero and a threshold voltage of the MOS capacitor. The following embodiments of the present invention provide a circuit design of a pixel circuitry for solving the said problems.

Figure 2A:
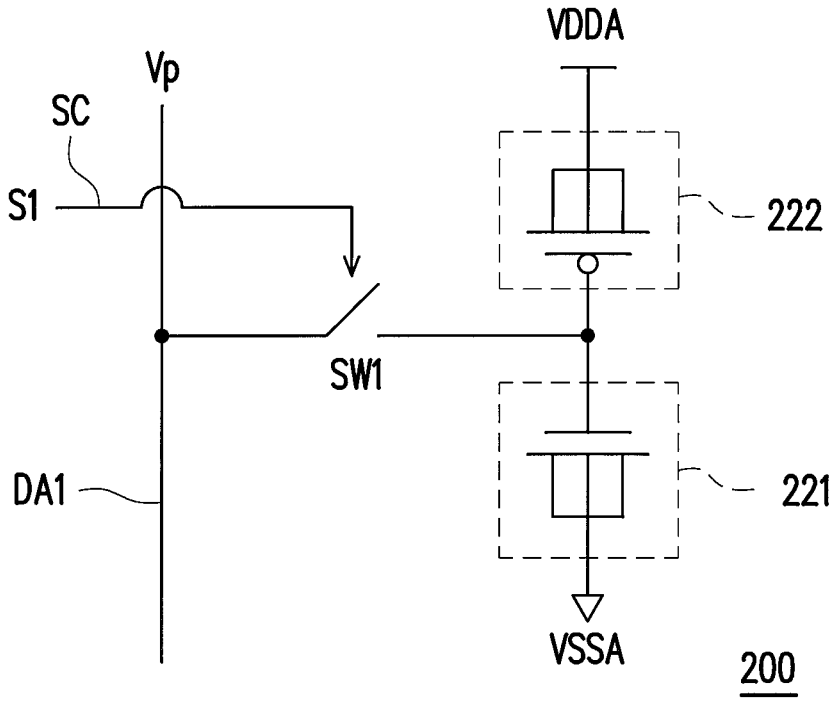
FIG. 2A is diagram of a pixel circuitry according to an embodiment of the present invention.

FIG. 2A is a diagram of a pixel circuitry according to an embodiment of the present invention. Referring to FIG. 2, the pixel circuitry 200 includes a switch SW1 and storage elements 121-122. The switch SW1 has an input terminal coupled to a data line DA1 for receiving a pixel signal Vp, and an output terminal coupled to the storage elements 221-222. The switch SW1 is conducted in response to a scan signal S1 for delivering the pixel signal Vp on the data line DA1 to the storage elements 221-222 for storing the pixel signal Vp. In the embodiment of the present invention, the storage elements 221-222 are respectively N-type metal-oxide-semiconductor (NMOS) capacitor and P-type metal-oxide-semiconductor (PMOS) capacitor. A first terminal and a second terminal of the storage element 221 are respectively coupled to the output terminal of the switch SW1 and a negative power voltage VSSA. A first terminal and a second terminal of the storage element 222 are respectively coupled to the output terminal of the switch SW1 and a positive power voltage VSSA.

Figure 1C:
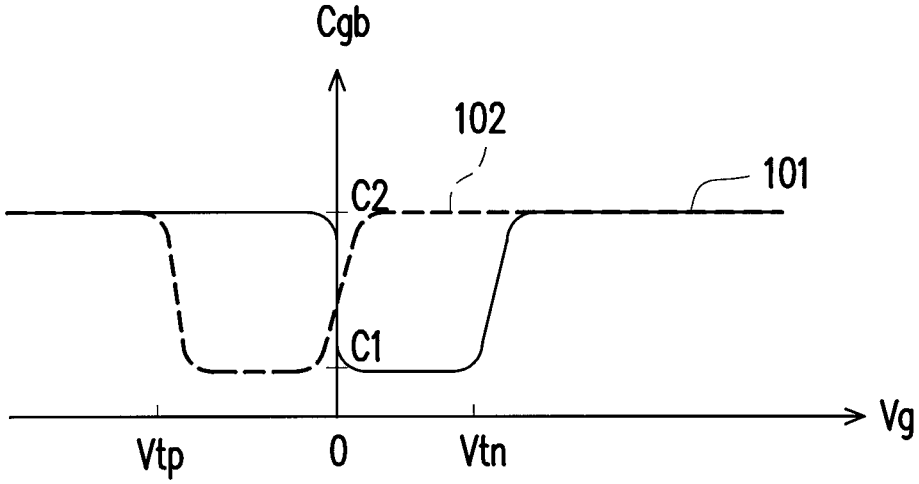
FIG. 1C (PRIOR ART)
FIG. 1C is a curve of a capacitance of the MOS capacitor under lower operation frequency.
Figure 2B:
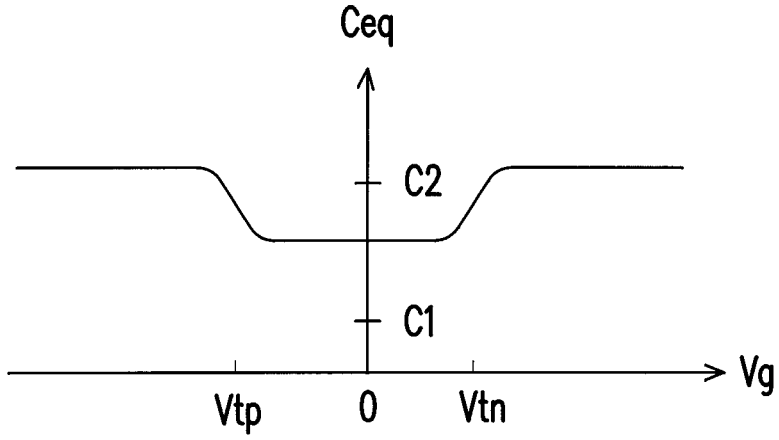
FIG. 2B is a curve of the equivalent capacitance of the storage elements under lower operation frequency according to the embodiment in FIG. 2A.

Referring to FIG. 1C, single storage element, either implemented by NMOS capacitor or PMOS capacitor, has capacitance changing as a gate voltage (i.e. a voltage of the pixel signal Vp delivered to storage element), and has insufficient capacitance for storing the pixel signal Vp when the voltage of the pixel signal Vp is between zero and the threshold voltage Vtn/Vtp. In the embodiment of the present invention, an equivalent capacitance of the storage elements 221-222, implemented by different types of MOS capacitor, can be increased for storing the pixel signal Vp when the voltage of the pixel signal Vp is between zero and the threshold voltage Vtn/Vtp. FIG. 2B is a curve of the equivalent capacitance of the storage elements under lower operation frequency according to the embodiment in FIG. 2A. Referring to FIG. 2A and FIG. 2B, the equivalent capacitance Ceq of the storage elements 221-222 is nearly an average capacitance of a capacitance obtained by using NMOS capacitor and a capacitance obtained by using PMOS capacitor. As shown in FIG. 2B, the equivalent capacitance Ceq of the storage elements 221-222 is efficiently increased when the voltage of the pixel signal Vp is between zero and the threshold voltage Vtn/Vtp.

Figure 3:
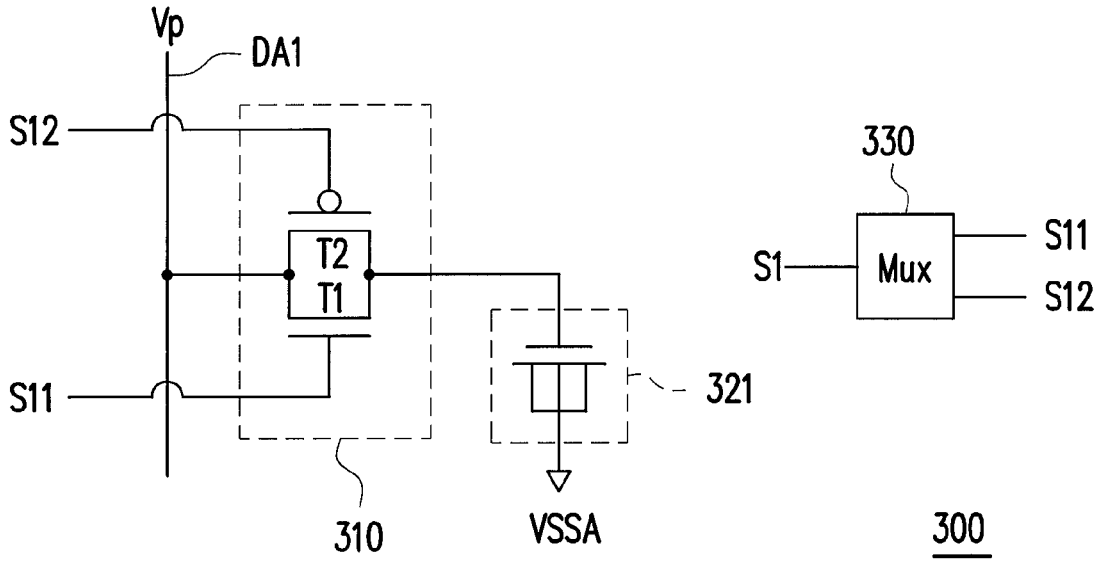
FIG. 3 is a diagram of a pixel circuitry according to an embodiment of the present invention.

FIG. 3 is a diagram of a pixel circuitry according to an embodiment of the present invention. Referring to FIG. 3, the pixel circuitry 300 includes a switching element 310 composed of a plurality of switches, a storage element 321, and a multiplexer 330. In the embodiment of the present invention, the switching element 310 includes the switches T1-T2, respectively implemented by an NMOS transistor and a PMOS transistor. The switches T1-T2 in parallel connection are respectively conducted in response to a first signal S11 and a second signal S12 derived from a scan signal S1. When the scan signal S1 is asserted, the multiplexer 330 generates the first signal S11 being in logic high and the second signal S12 being in logic low to synchronously conduct the switches T1-T2. Then, the switching element 310 delivers the pixel signal Vp on the data line DA1 to the storage element 321 for storing the pixel signal Vp. Contrarily, when the scan signal S1 is not asserted, the multiplexer 330 generates the first signal S11 being in logic low and the second signal S12 being in logic high to make the switches T1-T2 not conduct. The storage element 321 is a NMOS capacitor or other types of capacitor, e.g. poly-insulator-poly (PIP) structure, and metal-insulator-metal (MIM) structure, for storing the pixel signal Vp delivered by the switching element 310.

A voltage range, formed by the voltage VDDA and the voltage VSSA, can not be fully delivered through single switch, either implemented by NMOS transistor or PMOS transistor. In the embodiment of the present invention, the switches T1-T2 composing a transmission gate are synchronously conducted to deliver the pixel signal Vp within the voltage range between the voltage VDDA and the voltage VSSA without distortion. In other words, the pixel signal Vp having low voltage can be delivered by the switch T1 to the storage element 321 without distortion, and the pixel signal Vp having high voltage can be delivered by the switch T2 without distortion.

Figure 4:
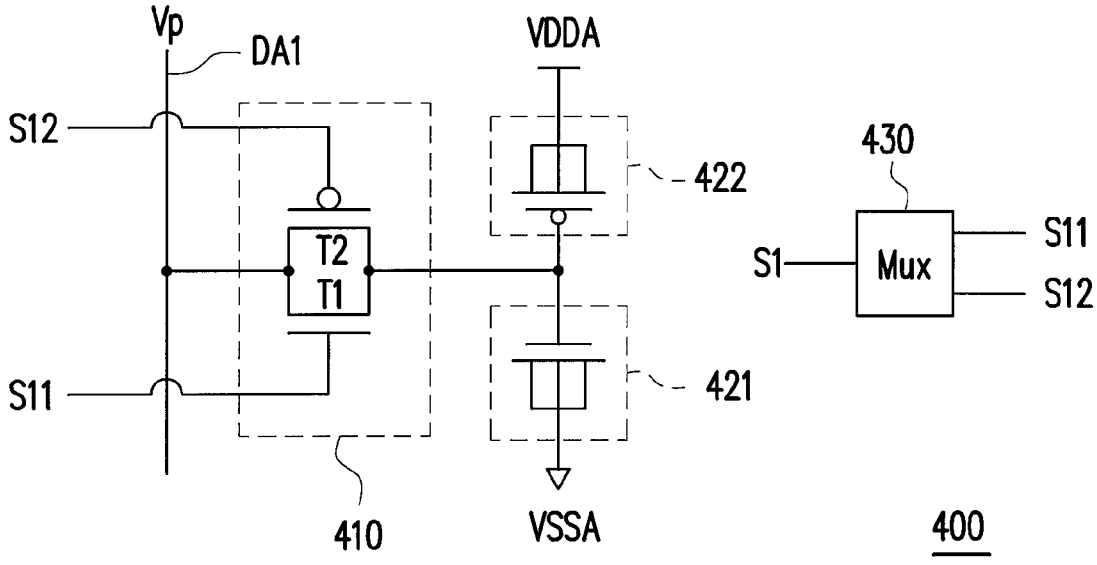
FIG. 4 is a diagram of a pixel circuitry according to an embodiment of the present invention.

FIG. 4 is a diagram of a pixel circuitry according to an embodiment of the present invention. Referring to FIG. 4, the difference between the embodiments in FIG. 3 and FIG. 4 is that the pixel circuitry 400 further includes a storage element 422 implemented by a PMOS capacitor. Referring to FIG. 2A and FIG. 2B, the connection of the storage elements 421-422 can increase an equivalent capacitance of the storage elements 421-422 for storing the pixel signal Vp when the voltage of the pixel signal Vp is between zero and the threshold voltage Vtn/Vtp.

In summary, the pixel circuitry in the said embodiment utilize two switches implemented by different types of MOS transistor and connected in parallel for ensuring the pixel signals within a voltage range between the voltage VDDA and voltage VSSA substantially fully pass the switching element to the storage element without being affected by body effect. The larger the voltage range that can be used for driving the pixel circuitry is, the higher the display quality is, because the larger voltage range can drive the pixel circuitry to display more gray scales of the image. In addition, the pixel circuitry utilizes two storage elements implemented by different types of MOS capacitor for increasing the equivalent capacitance to store the pixel signal.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A pixel circuitry for a display apparatus, comprising:

a first switch, having an input terminal receiving a pixel signal, and an output terminal, wherein the first switch is conducted in response to a scan signal;

a second switch, having an input terminal coupled to the input terminal of the first switch, and an output terminal coupled to the output terminal of the first switch;

a first storage element, having a first terminal coupled to the output terminal of the first switch, and a second terminal coupled to a first voltage for storing the pixel signal; and a second storage element, having a first terminal coupled to the output terminal of the first switch, and a second terminal coupled to a second voltage for storing the pixel signal, wherein the first storage element and the second storage element are composed of metal-oxide silicon capacitors, and are respectively a N-type metal-oxide-semiconductor capacitor and a P-type metal-oxide-semiconductor capacitor, the first switch and the second switch are synchronously conducted in response to the scan signal.

* * * * *